US005730395A

United States Patent [19]

Carmes

[11] Patent Number: 5,730,395

[45] Date of Patent: Mar. 24, 1998

[54] LOCKING APPARATUS FOR LOCKING A POINT OF A RAIL SWITCH, APPARATUS FOR OPERATING AND LOCKING A POINT, A METHOD OF INSTALLING SUCH APPARATUS, AND APPARATUS FOR OPERATING AND LOCKING A RAIL SWITCH

[75] Inventor: Francis Carmes, Voisins le Bretonneux, France

[73] Assignee: GEC Alsthom Transport SA, Paris, France

[21] Appl. No.: 753,113

[22] Filed: Nov. 20, 1996

[30] Foreign Application Priority Data

Nov. 22, 1995 [FR] France ..... 95 13874

[51] Int. Cl.[6] ..... E01B 7/00

[52] U.S. Cl. ..... 246/448; 246/420; 246/435 R

[58] Field of Search ..... 246/420, 435 R, 246/443, 448, 452

[56] References Cited

U.S. PATENT DOCUMENTS

| | | | |
|---|---|---|---|
| 4,842,225 | 6/1989 | Carmes | 246/435 R |
| 5,292,091 | 3/1994 | Callegari et al. | 246/448 |
| 5,462,245 | 10/1995 | Durchschlag | 246/448 |
| 5,566,912 | 10/1996 | Durchschlag | 246/448 |
| 5,620,156 | 4/1997 | Berggren et al. | 246/448 |

FOREIGN PATENT DOCUMENTS

| | | |
|---|---|---|
| 0289978A1 | 11/1988 | European Pat. Off. . |
| 0467865A1 | 1/1992 | European Pat. Off. . |

*Primary Examiner*—S. Joseph Morano
*Attorney, Agent, or Firm*—Sughrue, Mion, Zinn, Macpeak & Seas, PLLC

[57] ABSTRACT

In a locking apparatus for locking a point of a rail switch, a control bar and locking bars are disposed side-by-side, touching, and parallel to one another; first and second notches are provided in the same side of the control bar and of each of the locking bars; and the inside of the slideway and the outside of the assembly comprising the control bar and the locking bars are disposed side-by-side and touching, and are of complementary overall shapes so as to enable the control bar and the locking bars to slide relative to the slideway. The present invention also relates to an apparatus for operating and locking a point, to a method of installing this apparatus, and to an apparatus for operating and locking a rail switch.

18 Claims, 7 Drawing Sheets

LOCKING APPARATUS FOR LOCKING A POINT OF A RAIL SWITCH, APPARATUS FOR OPERATING AND LOCKING A POINT, A METHOD OF INSTALLING SUCH APPARATUS, AND APPARATUS FOR OPERATING AND LOCKING A RAIL SWITCH

FIELD OF THE INVENTION

The present invention relates generally to apparatuses for operating rail switches, and more particularly to a locking apparatus for locking a point of a rail switch, an apparatus for operating and locking a point, a method of installing such an apparatus, and an apparatus for operating and locking a rail switch.

BACKGROUND OF THE INVENTION

Apparatuses for operating switches situated on main tracks and used throughout the world may be put into two main categories: "trailable" apparatuses and "non-trailable" apparatuses. A definition of these terms and additional technical information on the state of the art are given, for example, in the Applicant's document EP 0 289 978.

Apparatuses for operating switches require the positions of the points to be monitored, and said points to be locked. Table 1 below gives the various trailable and non-trailable types of apparatuses for operating switches.

TABLE 1

| Type | Trailable | Non-trailable | Number of bars | Locking apparatus |
|---|---|---|---|---|
| I | | X | 1 | independent |
| II | X | X | 3 | independent |
| III | | X | 3 | integrated |
| IV | X | | 4 | integrated |
| V | | X | 4 | integrated |
| VI | | X | 2 | integrated |

As indicated in Table 1, the type II switch-operating apparatus is one of the rare apparatuses which has both a trailable version and a non-trailable version.

That switch-operating apparatus uses an apparatus for monitoring the points which is integrated into the operating mechanism, and a locking apparatus for locking the points which is independent of the operating mechanism.

However, it suffers from the drawbacks of requiring a complex mechanism and being complex to fix, having a low level of safety, and requiring a long time to be replaced.

Another drawback suffered by state-of-the-art point-locking apparatuses is that they are not capable of being adapted to fit a large number of different types of switch-operating apparatuses.

SUMMARY OF THE INVENTION

An object of the invention is to provide a locking apparatus for locking a point of a rail switch, and an apparatus for operating and locking a rail switch, which are capable of being adapted to fit a large number of different types of switches. An object of the apparatus of the invention is therefore to be compatible with prior art trailable or non-trailable apparatuses.

Another object of the invention is to provide an apparatus for operating and locking a rail switch which includes at least one locking apparatus for locking a point and can have a trailable version and a non-trailable version.

According to the invention, the locking apparatus for locking a point of a rail switch comprises: a slideway; a locking plate adjoining said slideway; a control element and at least one locking bar, said control element and said at least one locking bar being disposed to slide relative to the assembly comprising said slideway and said locking plate, said control element being capable of sliding relative to said locking bars; first and second moving pegs loosely held in first and second notches provided in said control element, and held free to rotate in first and second notches provided in each of said locking bars, said first and second moving pegs being suitable for being entrained by said first and second notches in said control element, and being suitable for longitudinally entraining said locking bars, said first and second moving pegs being perpendicular to the longitudinal axes of said control element and of said locking bars. Said control element is a control bar; said control bar and said locking bars are disposed side-by-side, touching, and parallel to one another; and said first and second notches are provided in the same side of said control bar and of each of said locking bars. The inside of the slideway and the outside of the assembly comprising the control bar and the locking bars, are disposed side-by-side and touching, and are complementary overall shapes so as to enable said control bar and said locking bars to slide relative to said slideway.

According to the invention, the apparatus for operating and locking a point of a rail switch includes a locking apparatus for locking said point, and a coupling apparatus for coupling said locking bars to said point.

The rear ends of said slideway, of said control bar, of said locking bars, and of said locking plate are suitable for being disposed on the opposite side of the rail from said point. The central portions of said slideway, of said control bar, of said locking bars, and of said locking plate are suitable for being disposed under said rail opposite from the point. An end of a frame disposed on said slideway is suitable for being secured to said opposite side of said rail from said point. The ends of the locking bars are suitable for being secured to said coupling apparatus for coupling said locking bars to said point. Said coupling apparatus for coupling said locking bars to said point is suitable for being fixed to said point; and the front end of the control bar is suitable for being secured to a push rod for pushing at least one point.

The apparatus of the invention for operating and locking a point of a rail switch also satisfies any one of the following characteristics: said coupling apparatus is suitable for being secured to said point so as to displace said point under the action of said push rod; said coupling apparatus is constituted by a yoke coupled to said locking bars via a bushing and via a screw; an adapting and fixing assembly for adapting and fixing to said point overlies said yoke; said adapting and fixing assembly comprises a pivot, an adapter bracket, and a coupling rod; said pivot is provided with a resilient hinge allowing said point a certain amount of freedom to be displaced vertically; a specific one of said adapter brackets is made for each fixing principle of said point; said adapter bracket fits either the web or the base of said point so that said apparatus for operating and locking said point fits a large number of points; and said coupling rod is disposed on said adapter bracket so as to allow said point to expand, and therefore said pivot to be displaced longitudinally relative to said point.

The apparatus for operating and locking a rail switch can include more than one apparatus according to the invention for operating and locking a point of said switch.

According to the invention, the method of installing the apparatus according to the invention for operating and locking a point of a rail switch, which includes locking apparatus according to the invention for locking said point, is such that: the rear ends of said slideway, of said control bar, of said locking bars, and of said locking plate are fixed on the opposite side of the rail from said point; the central portions of said slideway, of said control bar, of said locking bars, and of said locking plate are fixed under said rail opposite from said point; the end of a frame disposed on said slideway is fixed on said opposite side of said rail from said point; the ends of the locking bars are fixed to said coupling apparatus for coupling said locking bars to said point; said coupling apparatus for coupling the locking bars to said point is fixed to said point; and the front end of the control bar is fixed to a push rod for pushing at least one point.

The method of the invention also satisfies any one of the following characteristics: said yoke of said coupling apparatus is fixed to said locking bars via a bushing and via a screw; an assembly for adapting and fixing to said point, which assembly comprises a pivot, an adapter bracket and a coupling rod, overlies said yoke; a specific one of said adapter brackets is made for each fixing principle of said point; said adapter bracket is fixed either to the web or to the base of said point so that said apparatus for operating and locking said point fits a large number of points; and said point is displaced under the action of said push rod via said coupling apparatus.

An advantage of the locking apparatus of the invention for locking a point is that it avoids unwanted unlocking.

An advantage of the apparatus of the invention for operating and locking a rail switch is that it is easy and quick to install.

BRIEF DESCRIPTION OF THE DRAWINGS

Other objects, characteristics, and advantages of the invention appear on reading the following description of the preferred embodiments and implementations of the apparatus for locking a point of a rail switch, the apparatus for operating and locking a point, the method of installing such apparatus, and the apparatus for operating and locking a rail switch, given with reference to the drawings, in which.

DETAILED DESCRIPTION OF THE PREFERRED EMBODIMENTS

Figure 1:
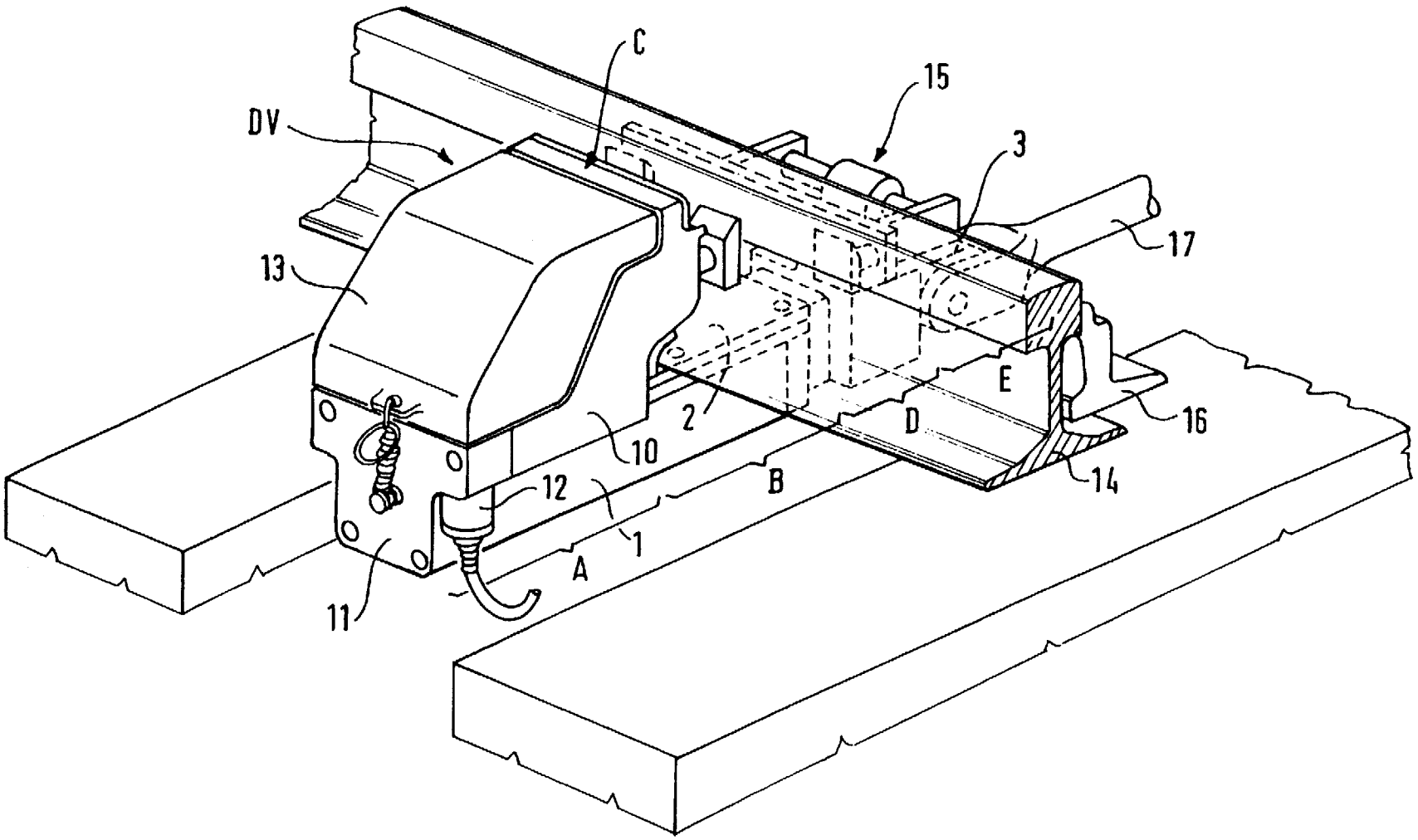
FIG. 1 is a perspective view of a locking apparatus of the invention for locking a point, and of an apparatus of the invention for operating and locking a point which includes such locking apparatus.

FIG. 1 is a perspective view of a locking apparatus DV of the invention for locking a point, and of an apparatus of the invention for operating and locking a point, which includes locking apparatus DV. This apparatus for operating and locking a point is mounted in part on a rail and in part on the point associated with the rail.

Figure 2:
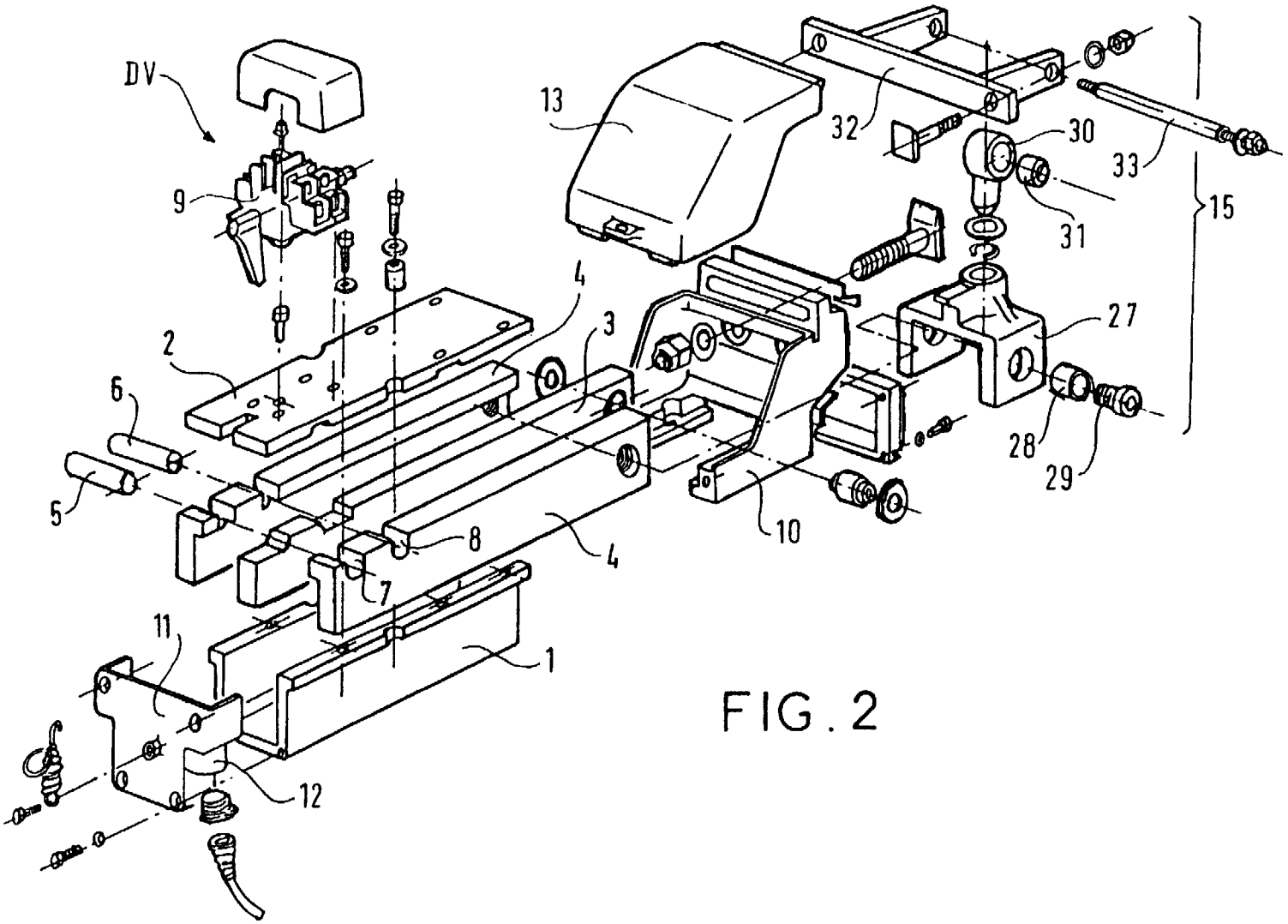
FIG. 2 is an exploded view of the locking apparatus of the invention for locking a point, and of the apparatus of the invention for operating and locking a point which includes such locking apparatus.

FIG. 2 is an exploded view of the apparatus of the invention for operating and locking a point, which includes locking apparatus DV.

As shown in FIGS. 1 and 2, locking apparatus DV is made up of a slideway 1, a locking plate 2, a control bar 3, and two locking bars 4. The locking plate 2 overlies the slideway 1. The control bar 3 and the two locking bars 4 are slidably mounted in the assembly comprising the slideway 1 and the locking plate 2. The control bar 3 can slide relative to the two locking bars 4. The control bar 3 is preferably disposed between the two locking bars 4.

First and second moving pegs 5, 6 are held free to rotate in first and second notches 7, 8 provided in each of the locking bars 4. The first and second moving pegs 5, 6 are perpendicular to the control bar 3 and to the locking bars 4. The first and second notches 7, 8 are preferably provided in the top portions of the control bar 3 and of the locking bars 4. The moving pegs 5, 6 essentially serve to entrain the locking bars 4 longitudinally under the effect of the control bar 3 being displaced longitudinally.

An electrical switch 9 is secured to the locking plate 2. A frame 10 supports the rear end of the slideway 1 and a rear cover 11. The rear cover 11 supports a cable outlet 12 connected to the electrical switch 9. The electrical switch 9 and the rear end A of the assembly comprising the frame 10, the slideway 1, the control bar 3, the locking bars 4, and the locking plate 2 are disposed on one side of the rail 14 associated with the operating and locking apparatus. A cover 13 may be fitted over this assembly.

The central portion B of the assembly comprising the slideway 1, the locking plate 2, the control bar 3, and the locking bars 4 is disposed under the rail 14 associated with the operating and locking apparatus. The front end C of the frame 10 is secured to the rail 14. Coupling apparatus 15 for coupling to the point 16 associated with the rail 14 is secured to the front ends D of the locking bars 4. The front end E of the control bar 3 is secured to a push rod 17 for pushing the points.

The coupling apparatus 15 serves to displace the point 16. The coupling apparatus 15 for coupling the locking bars 4 to the point 16 comprises a yoke 27 permanently coupled via a bushing 28 and via a special screw 29 locked securely after assembly by being welded to the yoke.

An adapting and fixing assembly for adapting and fixing to the point overlies the yoke. The adapting and fixing assembly comprises a pivot 30, an adapter bracket 32, and a coupling rod 33. The pivot 30 is provided with a resilient hinge 31 which allows the point 16 a limited amount of freedom to be displaced vertically. A specific adapter bracket 32 is made for each fixing principle of the point 16. The bracket 32 must fit either the web or the base of the point 16. The adapter bracket 32 enables the provision of an apparatus for operating and locking a point that can be adapted to a large number of different types of points. The coupling rod 33 is disposed on the adapter bracket 32 in such manner as to allow the point to expand, and therefore, to allow the pivot to be displaced longitudinally relative to the point.

The yoke 27 is provided with a lip machined to fit the profile of the point, which ensures, within the limits of safety, that the point is held in the event of failure of the coupling apparatus 15.

Figure 3A:
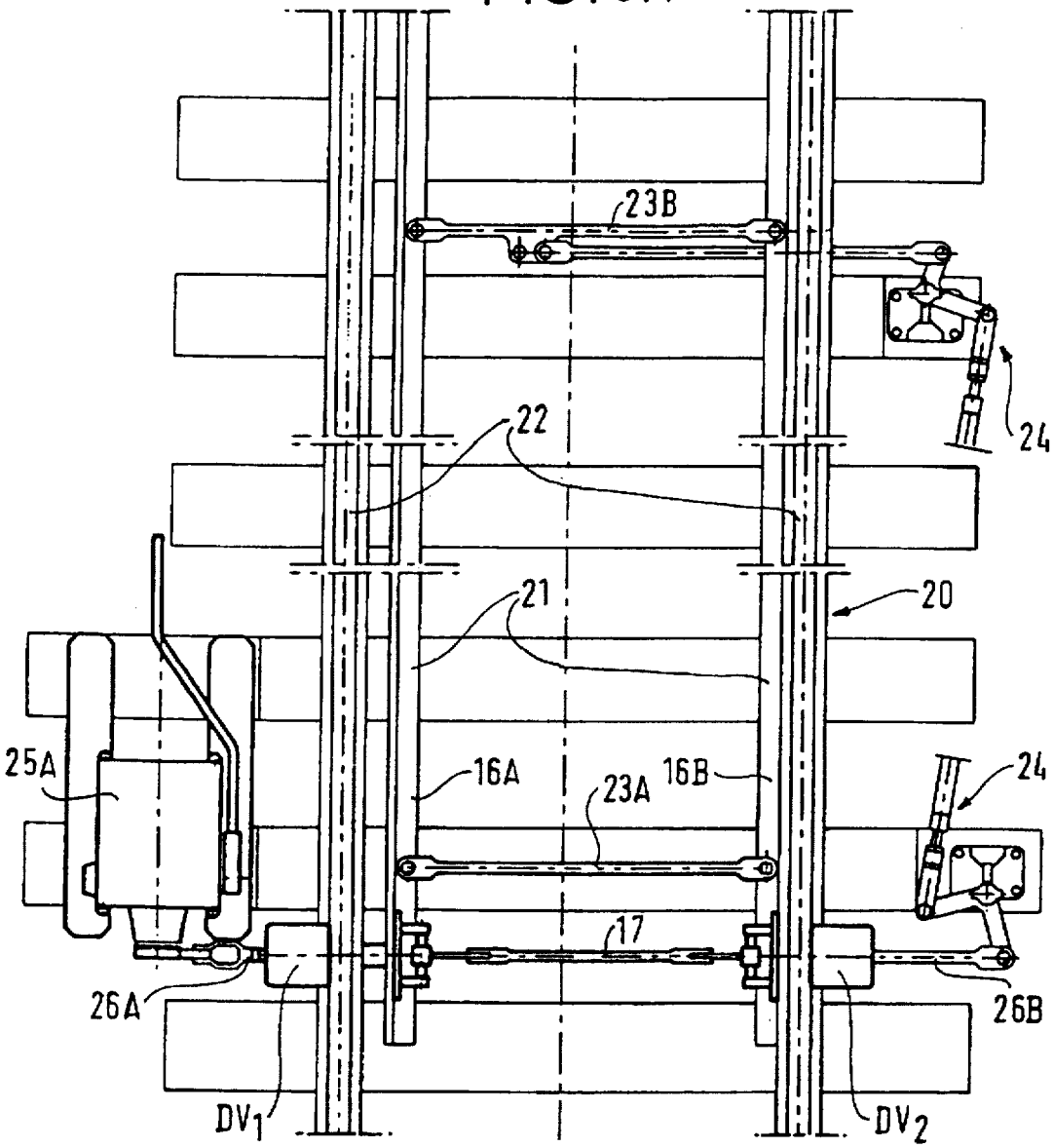
FIGS. 3A and 3B are respectively a plan view and a cross-section of view of a non-trailable apparatus for operating and locking switches, which includes two point-locking apparatuses of the invention.
Figure 3B:
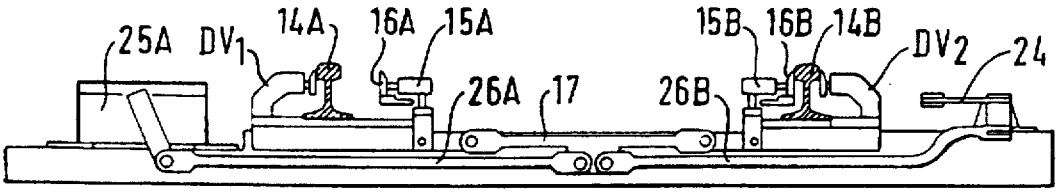

FIGS. 3A and 3B are respectively a plan view and a cross-sectional view of a the non-trailable apparatus for operating and locking switches, which includes two locking apparatuses $DV_1$, $DV_2$ of the invention for locking points 16A, 16B of set of points 21. FIGS. 3A and 3B show a rail switch 20 comprising a set 21 of flexible points, stock rails 22, a set of spacer rods 23A, 23B, a multiple engagement apparatus 24, a drive motor 25A and a first operating rod 26A, and two locking apparatuses $DV_1$, $DV_2$ for locking the points 16A, 16B of the set of points 21. The spacer bars 23A, 23B are of fixed length and couple together the points of the set of points 21.

The non-trailable apparatus for operating and locking switches may be provided with one or more trailing operating systems 24, 26A, 26B. It is operated via a drive motor 25A.

As shown in more detail in FIG. 3B, the first operating rod 26A is connected to the motor 25A, and to the central portion of a push rod 17 preferably by means of hinge tabs. The first operating rod 26A is extended to the multiple engagement apparatus 24 by a second operating rod 26B. The locking apparatuses $DV_1$, $DV_2$ for locking the points 16A, 16B of the set of points 21 are secured to respective ones of the rails 14A, 14B.

Figure 3C:
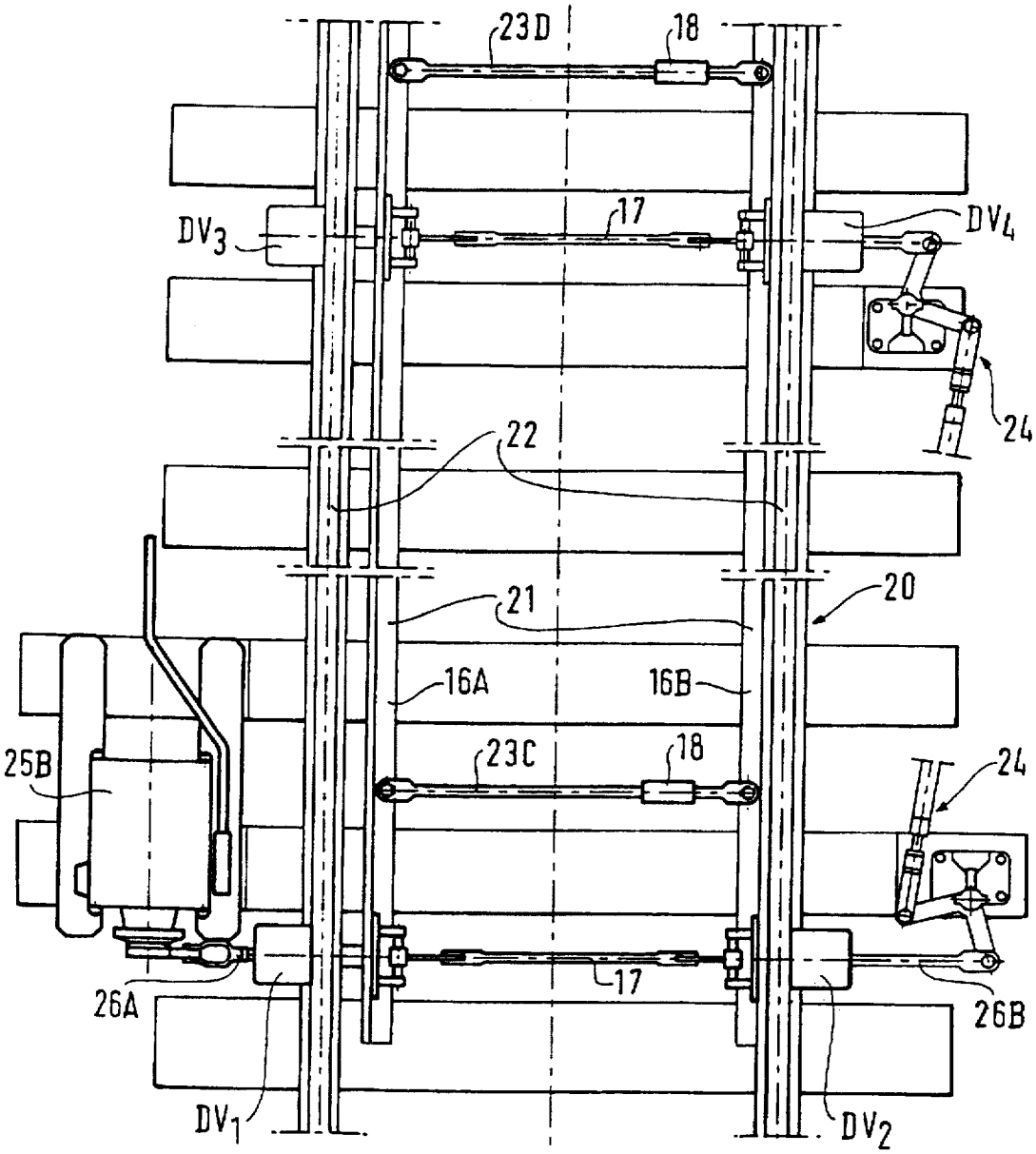
FIGS. 3C and 3D are respectively a plan view and a cross-sectional view of a trailable apparatus for operating and locking switches, which includes two pairs of point-locking apparatuses of the invention.
Figure 3D:
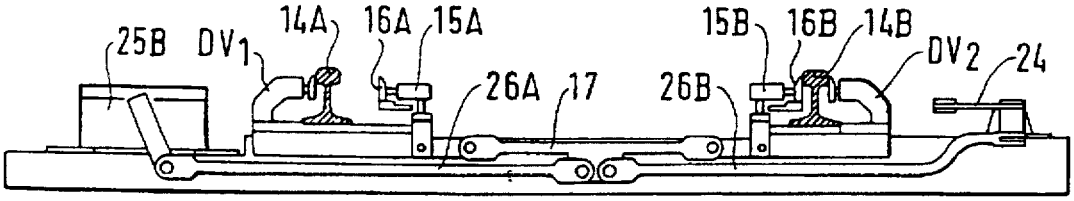

FIGS. 3C and 3D are respectively a plan view and an elevation view of a trailable apparatus for operating and locking switches, which comprises two or more pairs of locking apparatuses $DV_1$, $DV_2$, $DV_3$, $DV_4$ of the invention for locking the points 16A, 16B of the set of points 21. FIGS. 3C and 3D show a switch 20 comprising a set 21 of flexible points, stock rails 22, a set of spacer rods 23C, 23D, a multiple engagement apparatus 24, a drive motor 25B and a first operating rod 26A, and four locking apparatuses $DV_1$, $DV_2$, $DV_3$, $DV_4$ for locking the points 16A, 16B of the set of points 21.

The spacer bars 23C, 23D couple together the points of the set of points 21. The spacer bars 23C, 23D are resilient and they are provided with resilient means 18. The resilient means 18 of the spacer bars have extension strokes limited by abutments.

The trailable apparatus for operating and locking switches may be equipped with one or more trailing operating systems 24, 26, is operated via a drive motor 25B. The drive motor 25B has a resettable mechanical circuit-breaker inserted in its drive mechanism. The circuit-breaker is tripped under an abnormal force, e.g., as a result of a trailing effect on the trailable apparatus. Tripping of the circuit-breaker is monitored electrically.

As shown in more detail in FIG. 3D, the first operating rod 26A is connected to the motor 25B and to the central portion of the push rod 17 preferably by means of hinge tabs. The first operating rod 26A is extended to the multiple engagement apparatus 24 by a second operating rod 26B. The locking apparatuses $DV_1$ and $DV_3$ and the locking apparatuses $DV_2$ and $DV_4$ for locking respective ones of the points 16A, 16B of the set of points 21 are secured to respective ones of the rails 14A, 14B.

FIGS. 4A to 4E are sequential operating diagrams of the trailable apparatus for operating and locking switches, whose operation is effected by a drive motor.

Figure 4A:
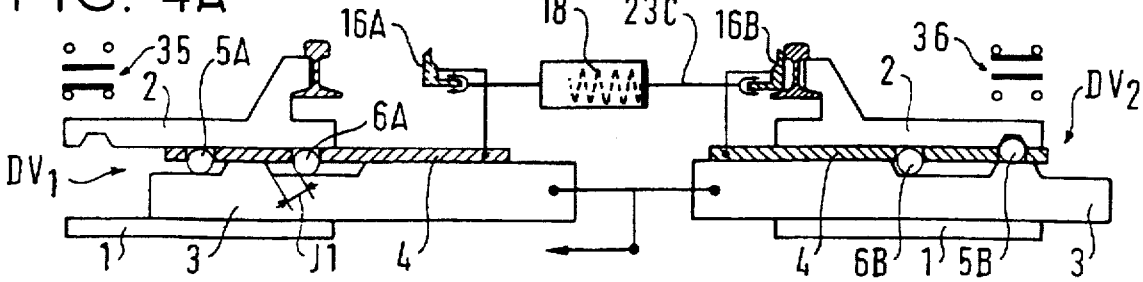
FIGS. 4A to 4E are sequential operating diagrams of the trailable apparatus for operating and locking switches, the operation being performed by a drive motor.

FIG. 4A shows the switch with its points locked to the right. The right point 16B is coupled to the locking bar 4 of the locking apparatus $DV_2$, the locking bar 4 being held stationary by the moving peg 5B since said peg 5B is engaged in a notch in the locking plate 2. The moving peg 5B is held firmly in the notch in the locking plate 2 by the control bar 3, the control bar 3 bearing against the frame 1 of the locking apparatus $DV_2$.

The locking apparatuses $DV_1$ and $DV_2$ are associated with electrical switches 9. The electrical contacts 35, 36 of the electrical switches serve to verify the positioning and the structural integrity of the control and locking elements, and to verify the actual positions of the points 16A, 16B. In the event of failure of one of the resilient spacer bars 23C, 23D while a vehicle is passing, the left locking apparatus $DV_1$ limits any closing of the open point 16A to the value of the clearance J1. The value of the clearance J1 is large enough to ensure that the vehicle passes quite safely and in fault mode. The failure is detected by the electrical monitoring apparatus.

Figure 4B:
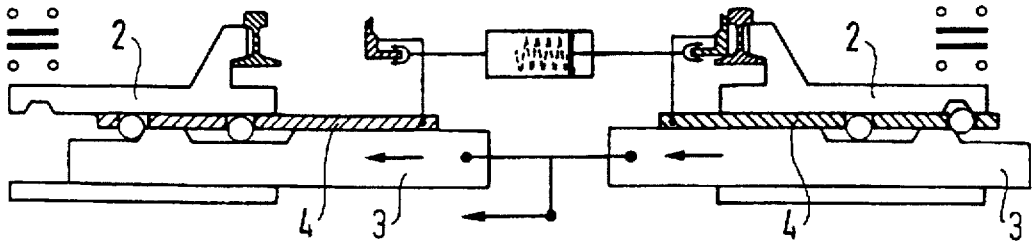

FIG. 4B shows the switch unlocked. The control bar 3 controlled by the drive motor is displaced leftwards. The electrical contacts 35, 36 open. The control bar 3 comes into contact with the moving peg 5A and pushes it, causing the left point 16A to move, and at least one resilient spacer bar 23C, 23D to be compressed to a limited extent. Since the strokes of the control bars are long, they cause the right point 16B to be unlocked ejecting the moving peg 5B from its notch.

Figure 4C:
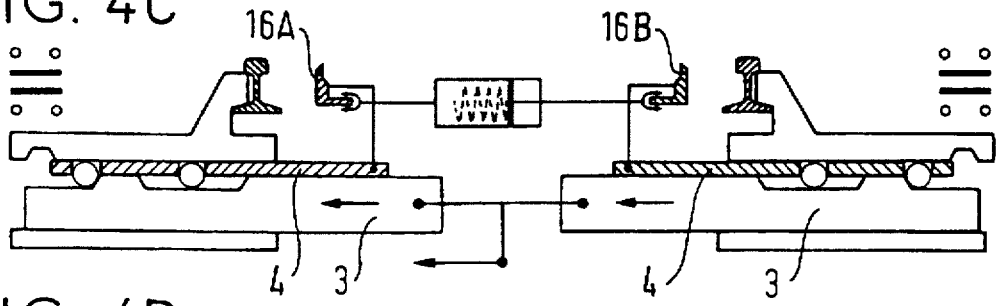

FIG. 4C shows the parallel movement of the points.

Figure 4D:
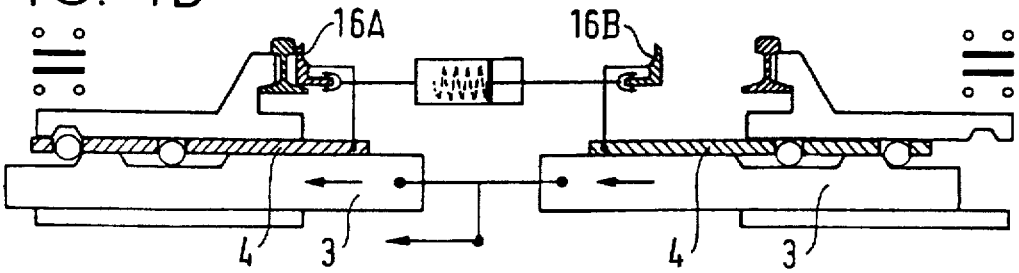

FIG. 4D shows the switch with its points locked to the left. The moving peg 5A of the left locking apparatus $DV_1$ is inserted into its notch by the control bar 3. The left point locks. The right point continues to open under the effect of at least one spring 18 of the spacer bars 23C, 23D. All of the electrical contacts 35, 36 of the electrical switches remain open.

Figure 4E:
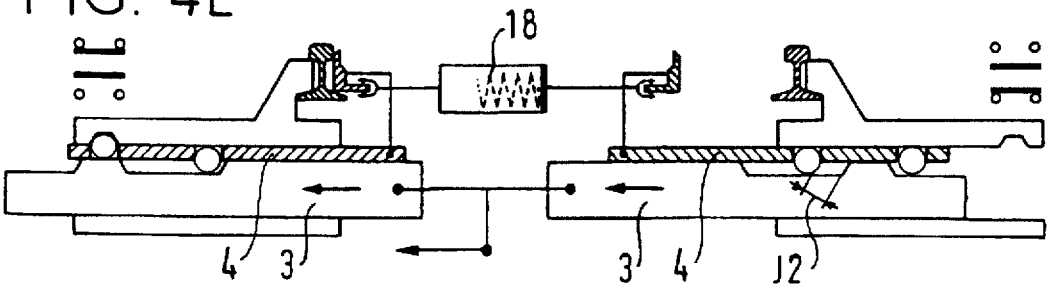

FIG. 4E shows the switch locked to the left. By stopping, the drive motor stops the movement of the operating bars 3. The left point 16A is locked. The springs 18 of the spacer bars 23C, 23D have completed opening of the right point 16B. The control bar 3 of the right locking apparatus $DV_2$ has released the moving peg 5B as a result of the clearance J2. The electrical contacts 35, 36 of the electrical switches make the circuits for monitoring opening and closing of the corresponding points.

It is important to note that the clearances J1 and J2 make the mechanical circuit-breaker of the drive motor insensitive regardless of the vibrations or impacts to which the open point is subjected while a vehicle is passing.

The trailable apparatus of the invention for operating and locking switches is not only freely moving, but requires a triggered and effective opening stroke of the open point before tripping the circuit-breaker of the drive motor itself.

FIGS. 4F to 4J are sequential operating diagrams of the trailable apparatus for operating and locking switches, where its operation is due to a passing vehicle.

Figure 4F:
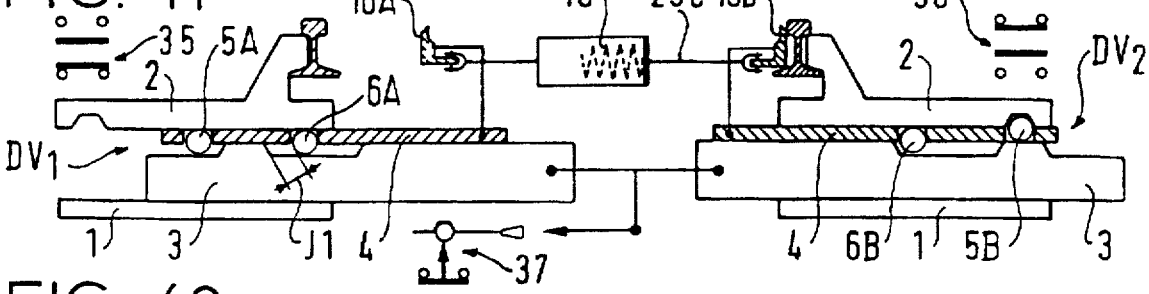
FIGS. 4F to 4J are sequential operating diagrams of the trailable apparatus for operating and locking switches, the operation being due to a passing vehicle.

FIG. 4F reproduces FIG. 4A and shows the switch with its points locked to the right.

Figure 4G:
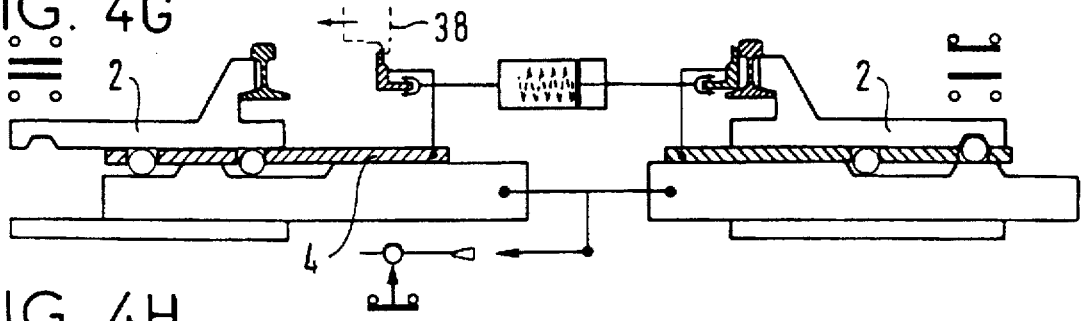

FIG. 4G shows the beginning of trailing of the switch. A vehicle arrives at the heel of the switch, the set of points not being in the correct position to allow the vehicle to pass. When a flange of a left wheel 38 of a vehicle pushes away the open point 16A, the electrical contact 35 for monitoring the position of the point **16*a* opens due to the displacement of the locking bars 4 of the locking apparatus $DV_1$. At least one of the springs 18 of the spacer bars 23C, 23D** is compressed.

Figure 4H:
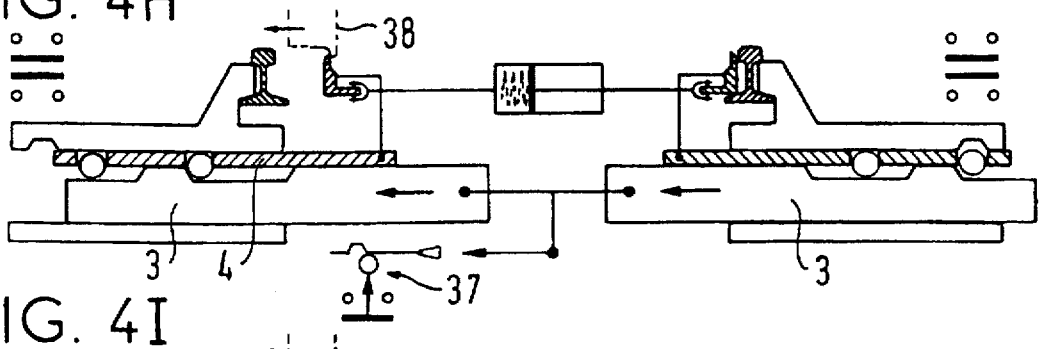

As shown in FIG. 4H, the two locking bars of the locking apparatus $DV_1$ come into contact with the moving peg 5A, thereby causing the control bars 3 to move, and thus the mechanical circuit-breaker of the drive motor to trip, and then the right point to be unlocked by the moving peg 5B of the locking apparatus $DV_2$.

Figure 4I:
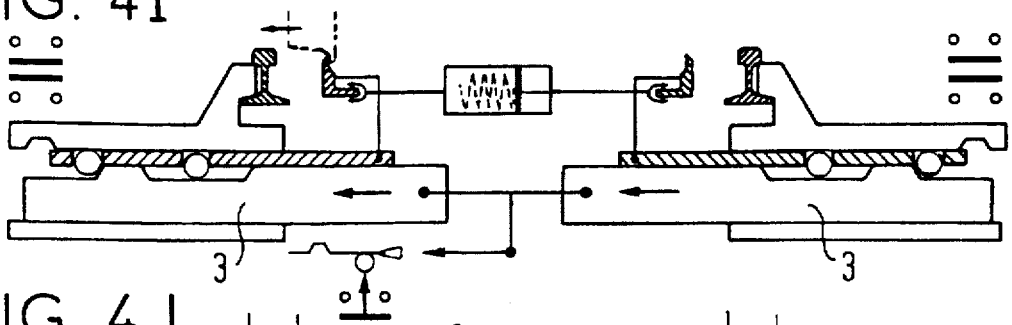

FIG. 4I shows the movement of the points as caused by the passing vehicle. The diagram in FIG. 4I corresponds to the diagram in 4C, the movement not being caused by the drive motor, but rather by the passing vehicle. During this movement of the points, the electrical contacts 36, 37 of the electrical switches are open.

Figure 4J:
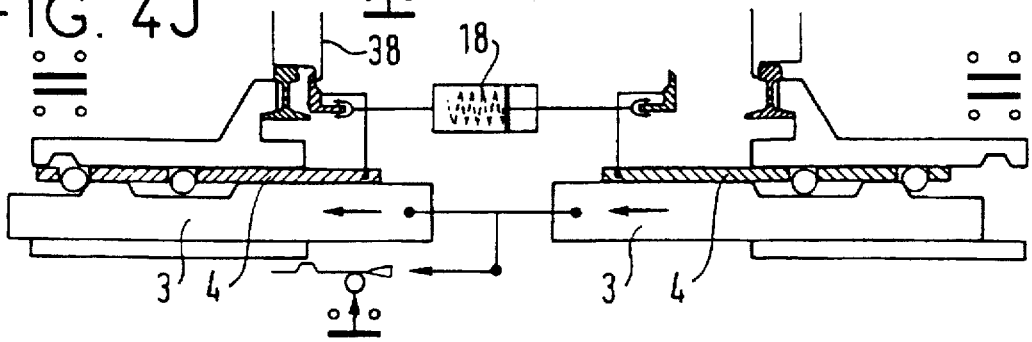

As shown in FIG. 4J, the trailing movement ceases once the space between the point 16A and the stock rail 14B is wide enough to enable the wheel to pass. All of the electrical contacts of the electrical switches are open.

Once the locking apparatus has been trailed, it can be reset by manually or electrically resetting the mechanical circuit-breaker of the drive motor. The switch is then returned to a normal situation as shown in FIG. 4F, the mechanical circuit-breaker then being electrically monitored again by means of the contact 37.

FIGS. 5A to 5E are sequential operating diagrams of a non-trailable apparatus for operating and locking switches, which comprises two locking apparatuses of the invention for locking points 16A, 16B.

Figure 5A:
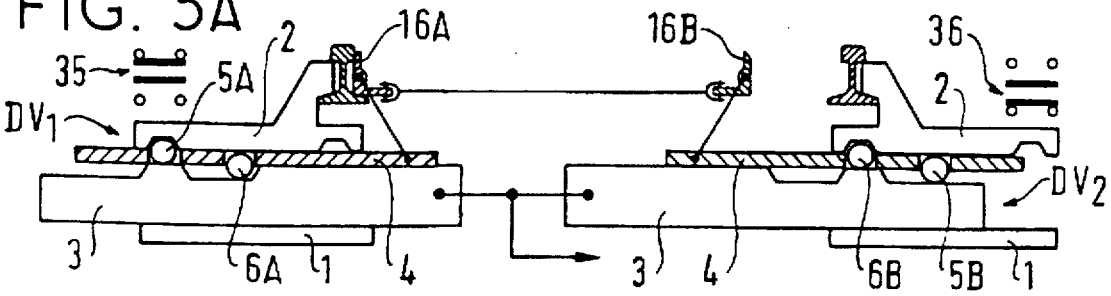
FIGS. 5A to 5E are sequential operating diagrams of a non-trailable apparatus for operating and locking switches.

FIG. 5A shows the switch with its points locked to the left. The left point 16A is coupled to the two locking bars 4 of the locking apparatus $DV_1$, the locking bars being held stationary by the moving peg 6A engaged in the notch in the locking plate 2. The moving peg 6A is held firmly in its notch by the control bar 3 which bears against the frame 1 of the locking apparatus $DV_1$. The right point 16B is locked in the same way by the right locking apparatus $DV_2$. The electrical contacts 35, 36 of the electrical switches monitor the positioning and the structural integrity of the control and locking elements, and the actual position of the point 16A and the opening of the point 16B.

Figure 5B:
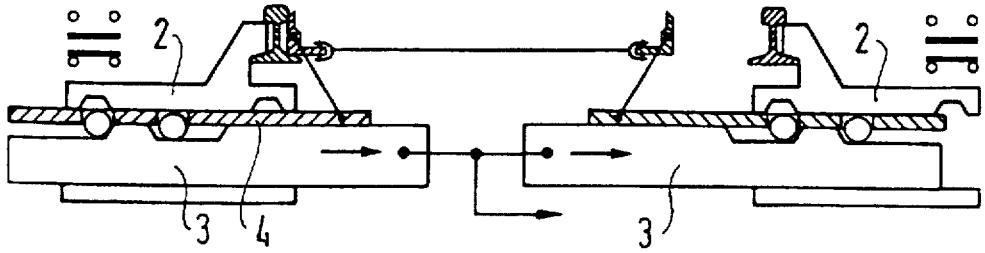

FIG. 5B shows unlocking of the set of points. The control bars 3 controlled by the drive motor are displaced rightwards. The electrical contacts 35 open. On coming into contact with the moving pegs 6A and 5B, the control bars cause the pegs 5A and 6B to be ejected, thereby unlocking the points 16A and 16B.

Figure 5C:
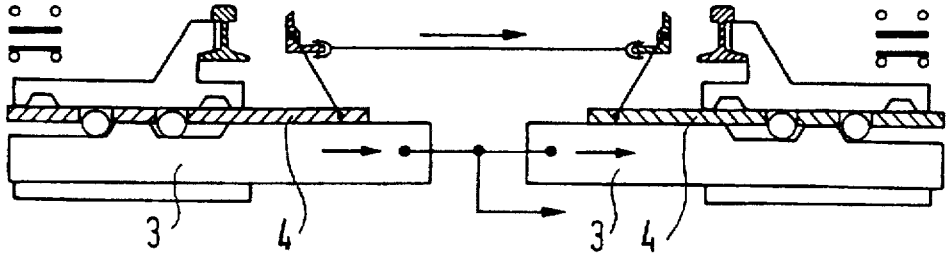

FIG. 5C shows the movement of the points. Since the locking bars are coupled to the control bars by means of moving pegs 5B and 6B in locking apparatus $DV_2$, and by means of moving pegs 5A and 6B in locking apparatus $DV_1$, all of the bars are displaced from left to right.

Figure 5D:
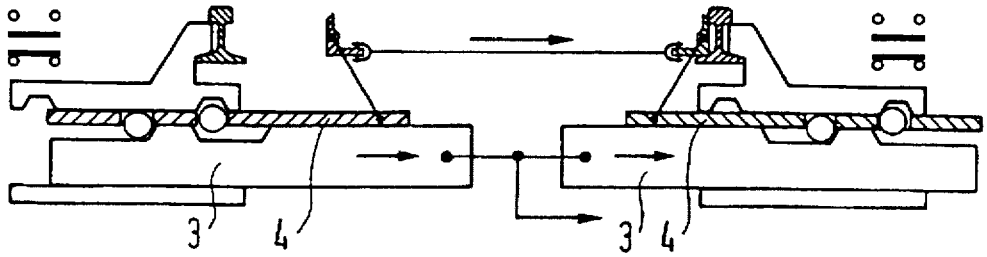

FIG. 5D shows the points locked to the right. The control bars continue to move under the effect of the drive motor. The right point 16B comes into contact with the stock rail 14B. The moving pegs 5B and 6A are pushed into the notches in their respective locking plates by the control bars.

Figure 5E:
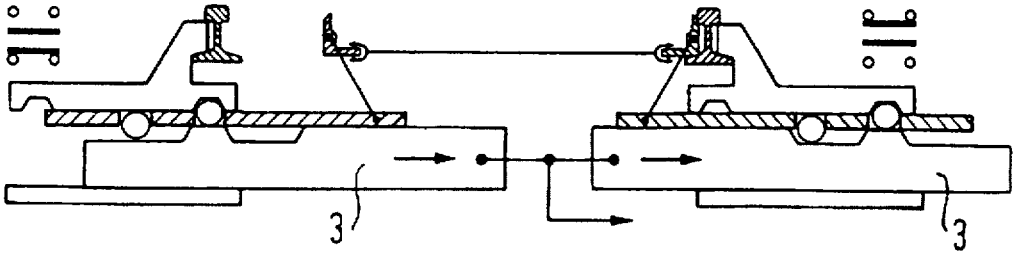

Finally, FIG. 5E shows the switch with its points locked to the right. The operating bars have stopped moving. The moving pegs 5B and 6A are firmly held in their notches by the control bars, the control bars bearing against the frames 1 of the respective locking apparatuses $DV_1$ and $DV_2$.

There follows from the above a method of installing the apparatus for operating and locking a point of a rail switch. The method using locking apparatus DV such as described above for locking the point is such that: the rear ends A of the slideway 1, of the control bar 3, of the locking bars 4, and of the locking plate 2 are fixed on the opposite side of the rail 14 from the point 16, the central portions B of the slideway 1, of the control bar 3, of the locking bars 4, and of the locking plate 2 are fixed under the rail 14 opposite from the point 16; the end C of a frame 10 disposed on the slideway 1 is fixed on the opposite side of said rail 14 from the point 16; the ends D of the locking bars 4 are fixed to coupling apparatus 15 for coupling the locking bars 4 to the point 16; said coupling apparatus 15 for coupling the locking bars 4 to the point 16 is fixed to the point 16; and the front end E of the control bar 3 is fixed to a push rod 17 for pushing at least one point 16.

I claim:

1. A locking apparatus for locking a point of a rail switch, comprising:

an assembly having a slideway and a locking plate adjoining said slideway;

a plurality of locking bars slidably disposed relative to said assembly, each of said locking bars having a first pair of notches;

a control bar slidably disposed relative to said assembly and relative to said locking bars, said control bar having a second pair of notches, said control bar and said locking bars being disposed side-by-side and parallel to each other, said first and second pairs of notches being disposed in the same side of said control bar and said locking bars, and communicable with each other; and first and second moving pegs rotatably held in said first set of notches of each of said locking bars;

wherein said first and second moving pegs are engageable with said second set of notches of said control bar for longitudinally entraining said locking bars.

2. An apparatus for operating and locking a point of a rail switch, said apparatus including the locking apparatus according to claim 1 for locking said point, and a coupling apparatus for coupling said locking bars to said point.

3. An apparatus according to claim 2, in which:

said point is associated with a rail and disposed on one side of said rail;

said locking apparatus further comprises a frame disposed on said slideway;

rear ends of said slideway, of said control bar, of said locking bars, and of said locking plate are respectively adapted to be disposed on an opposite side of the rail from said point;

central portions of said slideway, of said control bar, of said locking bars, and of said locking plate are adapted to be disposed under said rail;

an end of said frame disposed on said slideway is securable to said opposite side of said rail from said point;

an end of the locking bars are securable to said coupling apparatus for coupling said locking bars to said point;

said coupling apparatus for coupling the locking bars to said point is adapted to be fixed to said point; and a front end of the control bar is securable to a push rod for pushing said point.

4. An apparatus according to claim 3, in which said coupling apparatus is securable to said point so as to displace said point under the action of said push rod.

5. An apparatus according to claim 4, in which said coupling apparatus is constituted by a yoke coupled to said locking bars via a bushing and via a screw.

6. An apparatus according to claim 5, in which an adapting and fixing assembly for adapting and fixing said coupling apparatus to said point overlies said yoke.

7. An apparatus according to claim 6, in which said adapting and fixing assembly comprises a pivot, an adapter bracket, and a coupling rod.

8. An apparatus according to claim 7, in which said pivot is provided with a resilient hinge allowing said point to be displaced vertically.

9. An apparatus according to claim 7, in which a specific one of said adapter brackets is made for each of a plurality of fixing principles of said point.

10. An apparatus according to claim 9, in which said adapter bracket fits either a web or a base of said point so that said apparatus for operating and locking said point fits a large number of different types of points.

11. An apparatus according to claim 7, in which said coupling rod is disposed on said adapter bracket so as to allow said point to expand, and therefore said pivot to be displaced longitudinally relative to said point.

12. An apparatus for operating and locking a rail switch, including more than one apparatus according to claim 2 for operating and locking a point of said switch.

13. A method of installing an apparatus for operating and locking a point of a rail switch, said apparatus comprising an assembly having a slideway and a locking plate adjoining said slideway; a plurality of locking bars slidably disposed relative to said assembly, each of said locking bars having a first pair of notches; a control bar slidably disposed relative to said assembly and relative to said locking bars, said control bar having a second pair of notches, said control bar and said locking bars being disposed side-by-side and parallel to each other, said first and second pairs of notches being disposed in the same side of said control bar and said locking bars, and communicable with each other; first and second moving pegs rotatably held in said first set of notches of said locking bars; wherein said first and second moving pegs are engageable with said second set of notches of said control bar for longitudinally entraining said locking bars; and a coupling apparatus for coupling said locking bars to said point, wherein said point is associated with a rail and disposed on one side of said rail; said method comprising the steps of:

fixing rear ends of said slideway, of said control bar, of said locking bars, and of said locking plate on the opposite side of the rail from said point;

fixing central portions of said slideway, of said control bar, of said locking bars, and of said locking plate under said rail;

fixing an end of a frame disposed on said slideway on said opposite side of said rail from said point;

fixing ends of the locking bars to said coupling apparatus for coupling said locking bars to said point;

fixing said coupling apparatus to said point; and fixing a front end of the control bar to a push rod for pushing said point.

14. A method according to claim 13, in which a yoke of said coupling apparatus is fixed to said locking bars via a bushing and via a screw.

15. A method according to claim 14, in which an assembly for adapting and fixing said coupling apparatus to said point, which assembly comprises a pivot, an adapter bracket and a coupling rod, overlies said yoke.

16. A method according to claim 14, in which a specific one of said adapter brackets is made for each of a plurality of fixing principles of said point.

17. A method according to claim 16, in which said adapter bracket is fixed either to a web or to a base of said point so that said apparatus for operating and locking said point fits a large number of different types of points.

18. A method according to claim 13, in which said point is displaced under the action of said push rod via said coupling apparatus.

* * * * *